US005697353A

United States Patent [19]

Katoh et al.

[11] Patent Number: 5,697,353

[45] Date of Patent: Dec. 16, 1997

[54] FEEDBACK ENGINE CONTROL SYSTEM

[75] Inventors: Masahiko Katoh; Kimihiro Nonaka; Kazuhiro Nakamura, all of Hamamatsu, Japan

[73] Assignee: Sanshin Kogyo Kabushiki Kaisha, Hamamatsu, Japan

[21] Appl. No.: 481,846

[22] Filed: Jun. 7, 1995

[30] Foreign Application Priority Data

Jun. 24, 1994 [JP] Japan ..... 6-143669
Jun. 24, 1994 [JP] Japan ..... 6-143670
Jun. 24, 1994 [JP] Japan ..... 6-143671

[51] Int. Cl.[6] ..... F02D 41/14

[52] U.S. Cl. ..... 123/679; 123/681; 123/683; 123/689

[58] Field of Search ..... 123/672, 676, 123/679, 682, 683, 684, 685, 694, 695, 700, 701, 703, 681, 689

[56] References Cited

U.S. PATENT DOCUMENTS 4,526,001 7/1985 Burns et al. ..... 123/695
4,831,820 5/1989 Lassanske ..... 60/276
4,903,648 2/1990 Lassankse ..... 123/703
4,936,278 6/1990 Umeda ..... 123/684
4,982,714 1/1991 Takahashi et al. ..... 123/684
5,072,712 12/1991 Steinbrenner et al. ..... 123/684
5,215,068 6/1993 Kato ..... 123/676
5,337,722 8/1994 Kurihara et al. ..... 123/685
5,433,185 7/1995 Toyoda ..... 123/682

*Primary Examiner*—Willis R. Wolfe
*Attorney, Agent, or Firm*—Knobbe, Martens, Olson & Bear LLP

[57] ABSTRACT

Feedback control systems for engines employing combustion condition sensors. The feedback control is varied in response to various other parameters such as back pressure, engine speed, engine temperature, engine load and initial start-up operation so as to provide more accurate control under varying and transient conditions.

44 Claims, 17 Drawing Sheets

FEEDBACK ENGINE CONTROL SYSTEM

BACKGROUND OF THE INVENTION

This invention relates to an engine control system and more particularly to an improved feedback control system for an engine.

As has been known, it is extremely desirable to maintain the fuel/air ratio in the cylinders at the stoichiometric or leaner than stoichiometric running condition. This will promote not only good fuel economy but effective exhaust emission control.

Various control systems have been proposed for this purpose and a very popular system employs a feedback control employing an exhaust sensor. The exhaust sensor senses the condition of the exhaust gases and from that is able to determine whether the mixture is rich or lean in the combustion chamber from the contents of the exhaust gases. Through a feedback control system, the amount of fuel supplied and/or air supplied is varied so as to maintain the desired air/fuel ratio. This type of system is very effective.

The application of this type of control, however, to a two-cycle engine presents certain difficulties. One reason for this is that the exhaust gases in a two-cycle engine may in fact indicate a condition other than that that is representative of the combustion at the end of the combustion cycle. The reason for this is that two-cycle engines, because of their more frequent firing and their scavenging systems, can have a fresh fuel/air mixture present in the combustion chamber and also passing through the exhaust system. If this fresh mixture is mixed with the exhaust products, then the sensor will obtain a false reading.

There has, therefore, been proposed a type of system wherein the exhaust sensor actually senses the combustion products in a single cylinder immediately at the time of completion of combustion. This is done in a variety of manners and one very effective way of achieving this result is shown and described in the copending application of Masahiko Katoh, Ser. No. 08/435715, filed May 5, 1994 and assigned to the assignee hereof, still pending. In certain embodiments of that application, the exhaust sensor receives exhaust gases from one cylinder through a port that communicates with the cylinder at approximately the time when the exhaust port opens and before the scavenge port has been opened. This gas is then transmitted to an accumulator chamber in which a sensor is positioned and this chamber is discharged to another cylinder of the engine that is operating on another cycle so that the flow will, in essence, be in a constant direction from the cylinder being sensed.

Although the system disclosed in that application is extremely effective in providing a good signal of the what the actual engine running conditions are, if this reading is utilized to control the setting for the fuel/air ratio during following cycles without adjustment, the actual fuel/air ratio may vary more widely from that which is desired.

One reason for this is that the engine running conditions are very rarely static or stable. Therefore, when there is a transient condition, the feedback control may not provide the desired responsiveness.

It is, therefore, a principle object of this invention to provide an improved feedback control system for an engine wherein dynamic conditions are sensed and the target fuel/air ratio is set based upon these as well as the actual measured combustion conditions.

It is a further object of this invention to provide an improved and more responsive feedback control system for an engine that senses not only instantaneous combustion conditions but also which senses when dynamic conditions require a different fuel/air ratio.

Another disadvantage with conventional systems is that they tend to operate to provide adjustments in the air/fuel ratio in relatively small increments under all running conditions. That is, if there is a deviation there is not made a complete adjustment to compensate for the total deviation. Rather, the adjustments are made in steps which may occur at frequent intervals and which continue until the preset condition is reached. Although during normal running conditions, these types of systems may be adequate, they do not lend themselves to use when large variations in running conditions or sensed conditions may occur.

Although quicker response is possible by making larger adjustments, the use of larger adjustments under all circumstances can give rise to hunting and thus result in poor engine control.

It is, therefore, a still further object of this invention to provide an improved feedback control system that responds at different rates depending upon different running conditions.

It is a further object of this invention to provide an improved feedback control system where the response varies in relation to actual varying engine conditions so as to be more truly representative of the actual engine conditions.

For example, most conventional systems operate on the principle that the engine is running and fairly stable and that the deviations from the preset value will be relatively minor. Therefore, relatively minor adjustments are made in each increment. However, there are times when the deviations can be substantially greater. For example, during initial startup of the feedback control system, the initial engine condition may vary widely from the target condition. By making small incremental adjustments, reaching the desired condition may take some time.

It is, therefore, a still further object of this invention to provide an improved feedback control system that operates to provide more rapid adjustment during startup and then slower adjustments once the running conditions become more stabilized.

Another factor which effects the accuracy of feedback control is the inherent system delays. First, it takes time for the sensor output to stabilize and therefore the systems normally require some time delay before stabilization. Furthermore, once the control signal is given, there is a delay in the time when the system's mechanical components react so as to provide the adjustment called for by the sensed signal. As a practical matter, these delays become more significant under some running conditions than others.

It is, therefore, a still further object of this invention to provide an improved feedback control system wherein the system has a response time that is adjusted in response to engine characteristics so as to provide the desired degree of response for the given engine condition.

SUMMARY OF THE INVENTION

This invention is adapted to be embodied in a control system for an internal combustion engine having a combustion chamber. A charge forming and induction system supplies a charge to the combustion chamber. Means ignites the charge in the combustion chamber and exhaust means for discharging exhaust products from the combustion chamber. A detector is provided for sensing the combustion products and providing a signal indicative of the mixture strength in said combustion chamber. Control means provide a feedback control of the charge forming and induction system for maintaining the desired fuel/air ratio. The control means include means for sensing a condition other than fuel/air ratio and means for varying the feedback control in response to the other sensed engine conditions.

In accordance with one feature of the invention, the system operates so as to set up a target air/fuel ratio from the other condition and the sensor signal is interrelated with the target ratio so as to accomplish the feedback control. This other engine condition may be exhaust conditions, engine conditions associated with a vehicle powered by the engine, engine temperature or engine load.

In accordance with another feature of the invention, the rate at which the feedback control adjustments are made is varied depending upon the sensed other condition. This rate of change may be based upon the deviation from the desired signal in combustion conditions.

In accordance with a still further feature of the invention, a corrective factor or rate of response adjustment may be made in response to the sensed condition.

DETAILED DESCRIPTION OF THE PREFERRED EMBODIMENTS OF THE INVENTION

Figure 1:
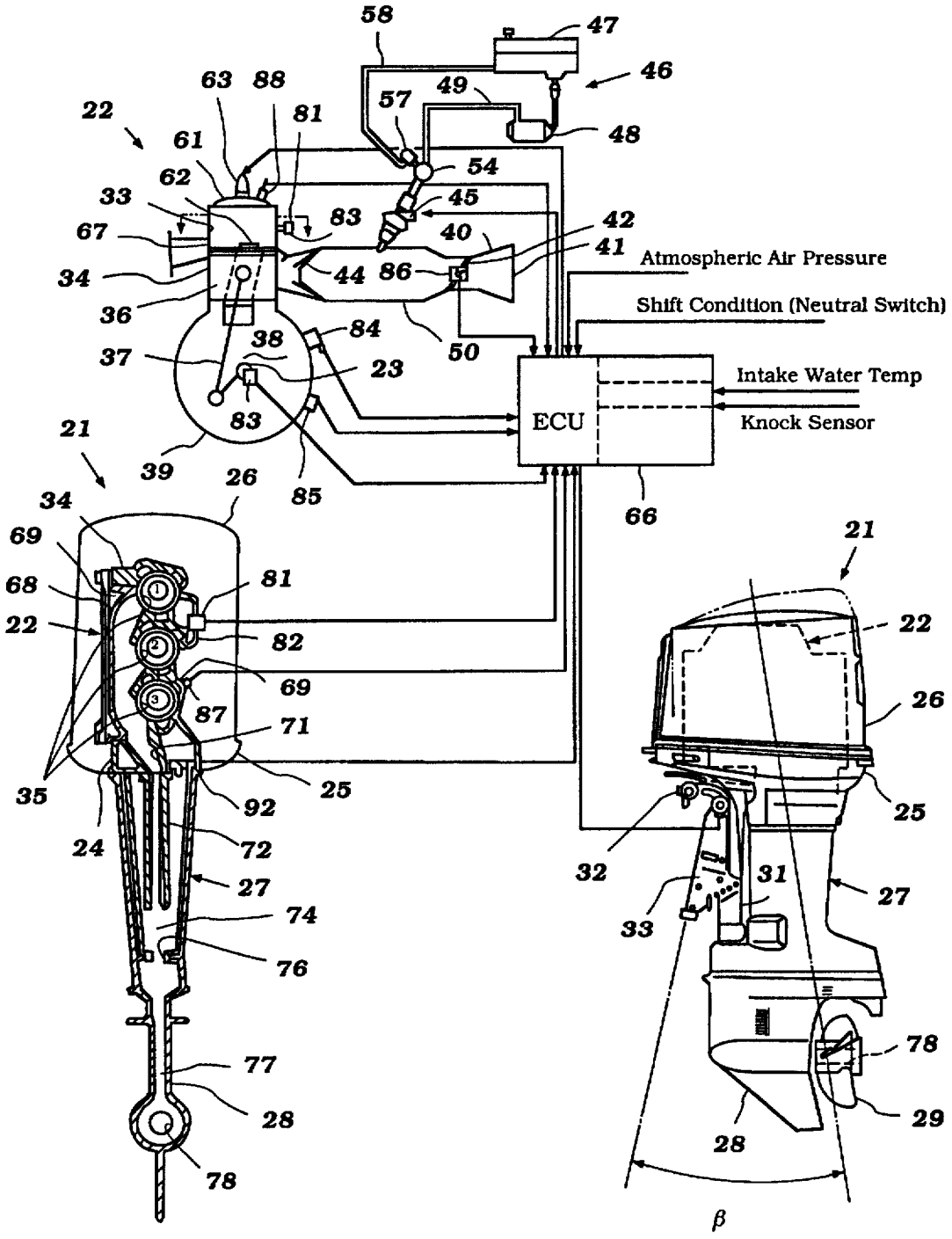
FIG. 1 is a three-part view showing an outboard motor constructed in accordance with an embodiment of the invention and side elevational view in the lower right-hand side, a cross-sectional view taken along a generally vertically extending plane on the lower left-hand side view and a schematic horizontal cross-sectional view through one cylinder of the engine and showing the control system and control elements partially in schematic form.

Referring now in detail to the drawings, and initially to FIG. 1, an outboard motor is shown in the lower portion of this figure in rear cross section and side elevation and is indicated generally by .the reference numeral 21. The invention is shown in conjunction with an outboard motor because the invention has particular utility in conjunction with two-cycle crankcase compression engines. Such engines are normally used as the propulsion device for outboard motors. For these reasons, the full details of the outboard motor 21 will not be described and have not been illustrated. Those skilled in the art can readily understand how the invention can be utilized with any known type of outboard motor. As will become apparent, many of the disclosed control features may be employed with other vehicle propulsion systems.

The outboard motor 21 includes a power head that is comprised of a powering internal combustion engine, indicated generally by the reference numeral 22. The engine 22 is shown in the lower view of FIG. 1, with a portion broken away, and in a schematic cross-sectional view through a single cylinder in the upper view of this figure. The construction of the engine 22 will be described later, but it should be noted that the engine 22 is mounted in the power head so that its crankshaft, indicated by the reference numeral 23, rotates about a vertically extending axis. The engine 22 is mounted on a guide plate 24 provided at the lower end of the power head and the upper end of a drive shaft housing, to be described. Finally, the power head is completed by a protective cowling comprised of a lower tray portion 25 and a detachable upper main cowling portion 26.

The engine crankshaft 23 is coupled to a drive shaft (not shown) that depends into and is rotatably journaled within the aforenoted drive shaft housing which is indicated by the reference numeral 27. This drive shaft then continues on to drive a forward/neutral/reverse transmission, which is not shown but which is contained within a lower unit 28. This transmission provides final drive to a propeller 29 in any known manner for propelling an associated watercraft.

A steering shaft (not shown) is affixed to the drive shaft housing 27. This steering shaft is journaled for steering movement within a swivel bracket 31 for steering of the outboard motor 21 and the associated watercraft (not shown) in a well-known manner. The swivel bracket 31 is, in turn, pivotally connected by a pivot pin 32 to a clamping bracket 33. The clamping bracket 33 is adapted to be detachably affixed to the transom of the associated watercraft. The pivotal movement about the pivot pin 32 accommodates trim and tilt-up operation of the outboard motor 21, as is well known in this art.

Continuing to refer to FIG. 1 and now primarily to the lower left-hand side view and the upper view, the engine 22 is depicted as being of the two-cycle crankcase compression type and, in the specific illustrated embodiment, is of a three-cylinder in-line configuration. Although this particular cylinder configuration is illustrated, it will be apparent to those skilled in the art how the invention may be employed with engines having other numbers of cylinders and other cylinder orientations. In fact, certain facets of the invention may also be employed with rotary or other ported type engines.

The engine 22 includes a cylinder block 34 in which three cylinder bores 35 are formed. Pistons 36 reciprocate in these cylinder bores 35 and are connected by means of connecting rods 37 to the crankshaft 23. The crankshaft 23 is, in turn, journaled for rotation within a crankcase chamber 38 in a suitable manner. The crankcase chamber 38 is formed by the cylinder block 34 and a crankcase member 39 that is affixed to it in any known manner.

As is typical with two-cycle crankcase compression engine practice, the crankcase chambers 38 associated with each of the cylinder bores 35 are sealed relative to each other in an appropriate manner. A fuel-air charge is delivered to each of the crankcase chambers 28 by an induction system which is comprised of an atmospheric air inlet device 40 which draws atmospheric air through an inlet 41 from within the protective cowling. This air is admitted to the protective cowling in any suitable manner.

A throttle body assembly 42 is positioned in an intake manifold 50 downstream of the air inlet 41 and is operated in any known manner. Finally, the intake system discharges into intake ports 43 formed in the crankcase member 39. Reed-type check valves 44 are provided in each intake port 43 for permitting the charge to be admitted to the crankcase chambers 38 when the pistons 36 are moving upwardly in the cylinder bore 35. These reed-type check valves 44 close when the piston 36 moves downwardly to compress the charge in the crankcase chambers 38, as is also well known in this art.

Fuel is added to the air charge inducted into the crankcase chambers 38 by a suitable charge former. In the illustrated embodiment, this charge former includes fuel injectors 45, each mounted in a respective branch of the intake manifold downstream of the respective throttle valve 42. The fuel injectors 45 are preferably of the electronically operated type. That is, they are provided with an electric solenoid that operates an injector valve so as to open and close and deliver high-pressure fuel directed toward the intake port Fuel is supplied to the fuel injectors 45 under high pressure through a fuel supply system, indicated generally by the reference numeral 46. This fuel supply system 46 includes a fuel tank 47 which is positioned remotely from the outboard motor 21 and preferably within the hull of the watercraft propelled by the outboard motor 21. Fuel is pumped from the fuel tank 47 by means of a fuel pump 48, which may be electrically or otherwise operated. This fuel then passes through a fuel filter, which preferably is mounted within the power head of the outboard motor 21. Fuel flows from the fuel filter through a conduit 49 to a high-pressure fuel pump which is driven in any known manner as by an electric motor or directly from the engine 22. This fuel pump delivers fuel under high pressure to a fuel rail 59 through a conduit. The fuel rail 54 serves each of the injectors 45 associated With the engine.

A return conduit 56 extends from the fuel rail 54 to a pressure regulator 57. The pressure regulator 57 controls the maximum pressure in the fuel rail 54 that is supplied to the fuel injectors 45. This is done by dumping excess fuel back to the fuel supply system through a return line 58 for example back to the fuel tank 47.

The fuel-air charge which is formed by the charge-forming and induction system as thus far described is transferred from the crankcase chambers 38 to combustion chambers, indicated generally by the reference numeral 59, of the engine. These combustion chambers 59 are formed by the heads of the pistons 36, the cylinder bores 35, and a cylinder head assembly 61 that is affixed to the cylinder block 34 in any known manner. The charge so formed is transferred to the combustion chamber 59 from the crankcase chambers 38 through one or more scavenge passages 62.

Spark plugs 63 are mounted in the cylinder head 61 and have their spark gaps extending into the combustion chambers 59. The spark plugs 63 are fired by a capacitor discharge ignition system (not shown). This outputs a signal to a spark coil which may be mounted on each spark plug 63 for firing the spark plug 63 in a known manner.

The capacitor discharge ignition circuit is operated, along with certain other engine controls by an engine management ECU, shown schematically and identified generally by the reference numeral 66.

When the spark plugs 63 fire, the charge in the combustion chambers 59 will ignite and expand so as to drive the pistons 36 downwardly. The combustion products are then discharged through exhaust ports 67 formed in the cylinder block 34. These exhaust gases then flow through an exhaust manifold identified by the reference numeral 68. The exhaust gases then pass downwardly through an opening in the guide plate 24 to an appropriate exhaust system (in the drive shaft housing 27) for discharge of the exhaust gases to the atmosphere. Conventionally, the exhaust gases are discharged through a high-speed under-the-water discharge and a low-speed, above-the-water discharge. The systems may be of any type known in the art.

The engine 22 is water cooled, and for this reason, the cylinder block 34 is formed with a cooling jacket 69 to which water is delivered from the body of water in which the watercraft is operating. Normally, this coolant is drawn in through the lower unit 28 by a water pump positioned at the interface between the lower unit 28 and the drive shaft housing 27 and driven by the drive shaft. This coolant also circulates through a cooling jacket formed in the cylinder head 61. After the water has been circulated through the engine cooling jackets, it is dumped back into the body of water in which the watercraft is operating. This is done in any known manner and may involve the mixing of the coolant with the engine exhaust gases to assist in their silencing. This will also be described later.

Although not shown in the drawings, the engine 22 is also provided with a lubricating system for lubricating the various moving components of the engine 22. This system may spray lubrication into the intake passages in proximity to the fuel injector nozzles 45 and/or may deliver lubricant directly to the sliding surfaces of the engine 22. This lubricant is supplied from a suitably positioned tank.

The exhaust system for discharging the exhaust gases to the atmosphere will be described. As has been noted, the exhaust manifold 68 communicates with an exhaust passage, indicated by the reference numeral 71, that is formed in the spacer or guide plate 24. An exhaust pipe 72 is affixed to the lower end of the guide plate 24 and receives the exhaust gases from the passage 71.

The exhaust pipe 72 depends into an expansion chamber 74 formed within the outer shell of the drive shaft housing 27. This expansion chamber 74 is defined by an inner member which has a lower discharge opening 76 that communicates with an exhaust chamber 77 formed in the lower unit 28 and to which the exhaust gases flow.

A through-the-hub, high speed, exhaust gas discharge opening 78 is formed in the hub of the propeller 29 and the exhaust gases exit the outboard motor 22 through this opening below the level of water in which the watercraft is operating when traveling at high speeds. In addition to this high speed exhaust gas discharge, the outboard motor 21 may be provided with a further above-the-water, low speed, exhaust gas discharge (not shown). As is well know in this art, this above-the-water exhaust gas discharge is relatively restricted, but permits the exhaust gases to exit without significant back pressure when the watercraft is traveling at a low rate of speed or is idling, and the through-the-hub exhaust gas discharge 78 will be deeply submerged.

It has been noted that the ECU 66 controls the capacitor discharge ignition circuit and the firing of the spark plugs 63. In addition, the ECU controls the fuel injectors 45 so as to control both the beginning and duration of fuel injection and the regulated fuel pressure, as already-noted. The ECU 66 may operate on any known strategy for the spark control and fuel injection control 45, although this system employs an exhaust sensor assembly indicated generally by the reference numeral 81 constructed in accordance with any of the embodiments of the aforenoted application Ser. No. 08/435,715, still pending, the disclosure of which is incorporated herein by reference. Specifically, the embodiment illustrated here embodies the same sensor construction as shown in FIGS. 1–10 of that copending application. Since the invention in this application deals primarily with the control system rather than the construction of the sensor, the sensor per se will not be described in detail. However, the principal of operation of the sensor will be described later when the mode of operation of the preferred embodiment of this invention is described.

The sensor 81 is positioned in a conduit 82 that is interconnected between two of the cylinders (cylinders 1 and 2 in the illustrated embodiment) for a reason which will also be described later.

So as to permit engine management, a number of additional sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors as shown schematically in FIG. 1 include a crankshaft position sensor 83 which senses the angular position of the crankshaft 23 and also the speed of its rotation. A crankcase pressure sensor 84 is also provided for sensing the pressure in the individual crankcase chambers 38. Among other things, this crankcase pressure signal may be employed as a means for measuring intake air flow and, accordingly, controlling the amount of fuel injected by the injector 45, as well as its timing.

A temperature sensor 85 may be provided in the crankcase chamber 38 for sensing the temperature of the intake air. In addition, the position of the throttle valve 42 is sensed by a throttle position sensor 86. Engine temperature is sensed by a coolant temperature sensor 87 that is mounted in an appropriate area in the engine cooling jacket 69. An in-cylinder pressure sensor 88 may be mounted in the cylinder head 61 so as to sense the pressure in the combustion chamber 59.

Other sensors which are not shown but their outputs to the ECU are noted in FIG. 1 include a knock sensor may also be mounted in the cylinder block 34 for sensing the existence of a knocking condition. Certain ambient conditions also may be sensed, such as atmospheric air pressure, intake cooling water temperature, this temperature being the temperature of the water that is drawn into the cooling system before it has entered the engine cooling jacket 69.

In accordance with some portions of the control strategy, it may also be desirable to be able to sense the condition of the transmission for driving the propeller 29 or at least when it is shifted into or out of neutral. Thus, a transmission condition sensor is mounted in the power head and cooperates with the shift control mechanism for providing the appropriate indication as indicated schematically.

Furthermore, a trim angle sensor 91 is provided for sensing the angular position of the swivel bracket 31 relative to the clamping bracket 33 and the trim angle $\beta$ of the outboard motor 21.

Finally, the engine exhaust gas back pressure is sensed by a back pressure sensor that is positioned within the expansion chamber 74 which forms part of the exhaust system for the engine and which is positioned in the drive shaft housing 27.

Figure 2:
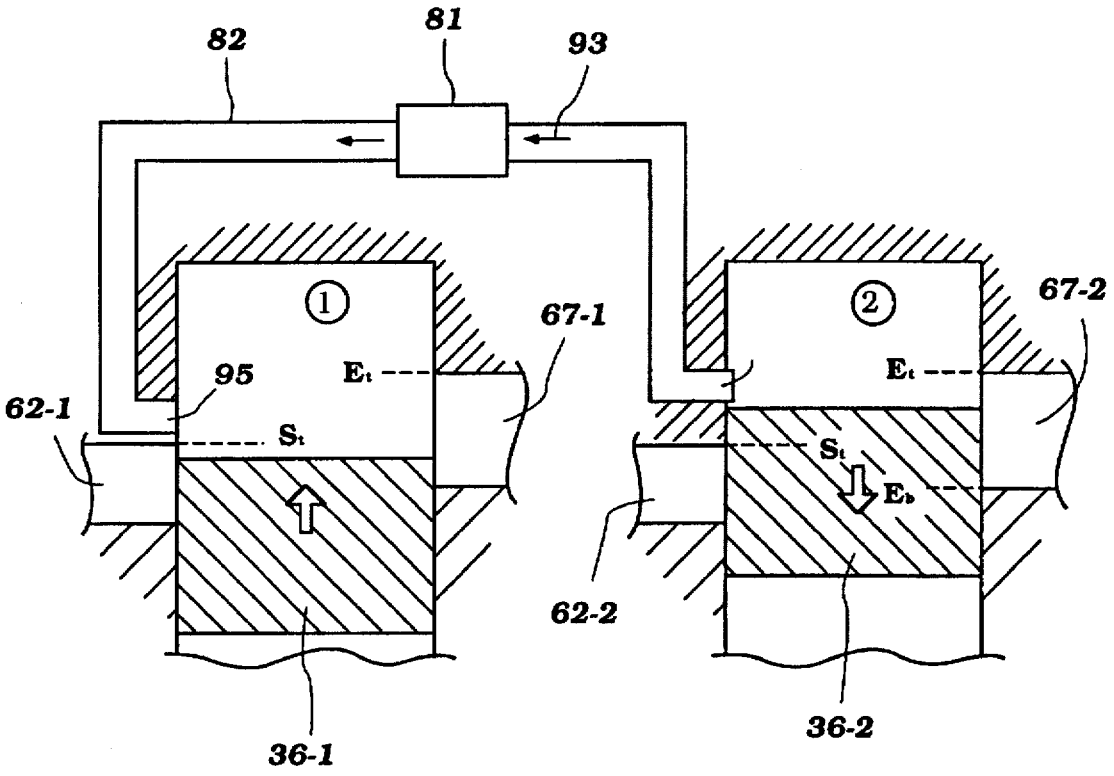
FIG. 2 is an enlarged schematic cross-sectional view taken through two cylinders of the engine and showing the connection of the exhaust sensor thereto.

The way in which the exhaust sensor 81 operates so as to sample the combustion products from one of the cylinders at the end of the combustion cycle without being diluted with incoming charge is described in more detail in the aforenoted copending application but the theory will be described by particular reference to FIGS. 2 and 3 since they indicate how the system provides good sampling and undiluted sampling so that the exhaust sensor 81, which as has been noted is an $O_2$ sensor, can provide good feedback control.

Basically, the theory of operation is that the conduit 82 that supplies the sample of combustion products to the sensor 81 is interconnected between two cylinders that are out of phase with each other. In the illustrated embodiment, these are the cylinders 1 and 2 numbering the cylinders from the top and wherein cylinder 2 is the active cylinder from which the combustion products are sampled. Cylinder 1 acts, in effect, as a valve to control the direction of flow so that it is generally in the direction of the arrows 93 shown in FIG. 2 so that the combustion products from cylinder 2 are sampled and also they are sampled at a point at the end of the combustion cycle.

Basically, the conduit 82 has a port opening 94 into cylinder 2 at a point that is approximately equal to the point when the exhaust port 67-2 is open ($E_x$). This is at a time when the combustion in cylinder 2 is substantially completed and the exhaust port will open so that the exhaust gases can flow out of the exhaust port 67-2. As may be seen in FIG. 3, which is a pressure trace of the cylinder pressures with the cylinder 2 pressure being indicated at P2 and the pressure in cylinder 1 being indicated at P1. It will be seen that when the piston 36-2 sweeps across the port 94 the pressure in the combustion chamber of cylinder 2 will have been falling because the gases have been burning and expanding. At the point in time when the exhaust port opens the pressure will continue to be dropping but it will still be greater than the atmospheric pressure indicated at the value 1 in FIG. 3.

The conduit 82 also has a port opening 95 which communicates with cylinder 1 but this port opening is disposed to be immediately adjacent the point when the scavenge port 62-1 of cylinder 1 is closed by the upward movement of the piston 36-1. Hence, there will be a positive flow from the cylinder 2 to the cylinder 1 through the sensor 81 and conduit 82 at this time period. At this point in time, cylinder 1 will have its pressure generally at atmospheric pressure because the charge which has been compressed in the crankcase chamber and is transferred to the combustion chamber will not have undergone any further pressure in the cylinder 1. Hence, the flow is in the direction of the arrow 93.

As may be seen, when the piston 36-2 continues to move downwardly eventually the scavenge port 62-2 will open and then the diluting charge will enter the combustion chamber of cylinder 2. However, by this time the port 95 in cylinder 1 will have been closed and hence no flow can occur through the conduit 82 and the sensor 81 will only receive final combustion products from cylinder 2 at the end of the cycle.

Figure 3:
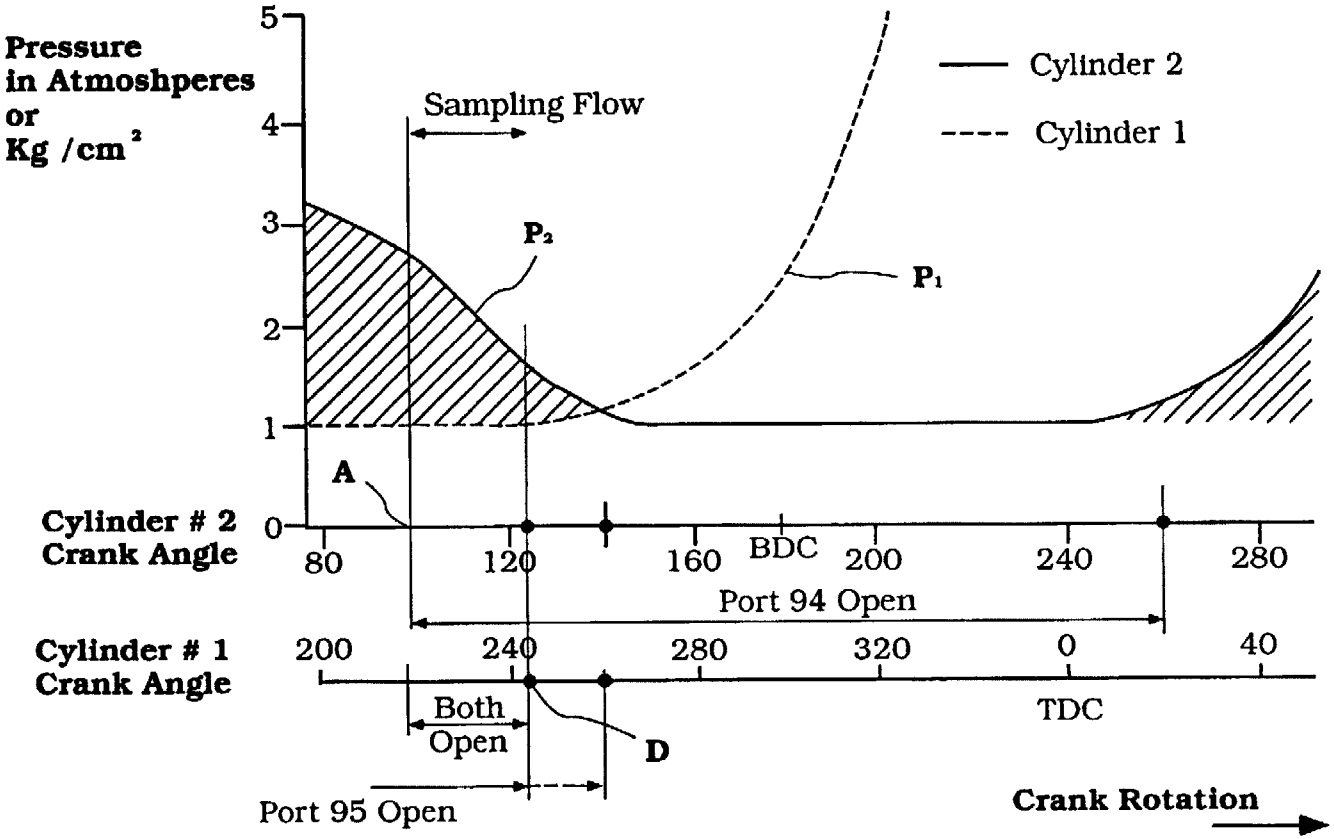
FIG. 3 is a graphical view showing the relationship of the pressure in the various cylinders and to illustrate how the exhaust sampling is controlled.

The sampling time is as indicated on the timing diagram of FIG. 3 and this being basically the time when both ports 94 and 95 are open. In fact, when port 95 is closed and port 94 is still open, the pressure in the conduit 82 will be higher than the pressure in the cylinder 2 and hence there will actually be some purging of the accumulator chamber containing the sensor 81 back into the cylinder 2 so that the sensor 81 always receives a fresh charge of combustion products for each cycle.

Because the port opening 94 of the conduit 82 in cylinder 2 is higher in the cylinder bore than the port opening 95 in cylinder 1, port opening 94 will be open for a longer period of time than will the opening of port 95. These respective timings are indicated in the distance between the points A and D in FIG. 3 and this is the time when the actual sampling will occur.

Figure 4:
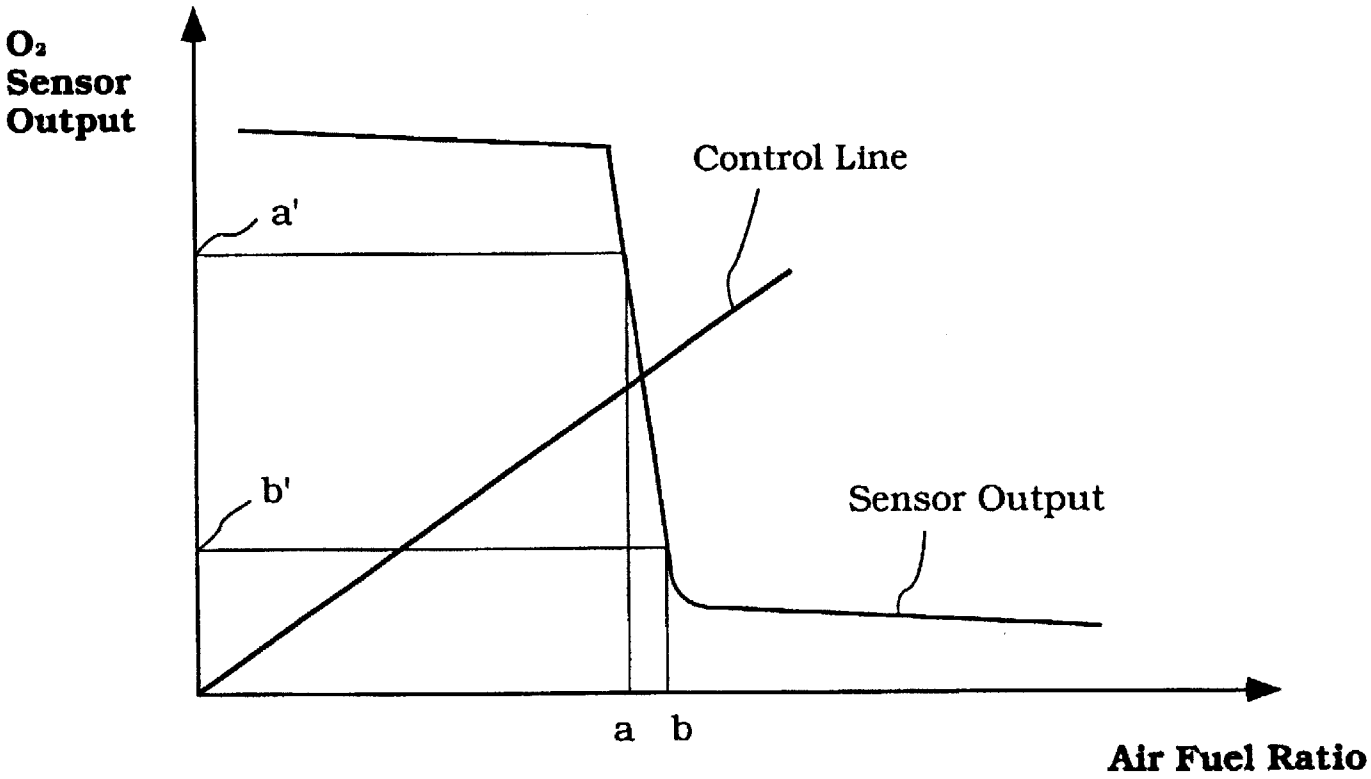
FIG. 4 is a graphical view showing the output of an oxygen sensor in relation to air/fuel ratio and the control range applied.

As is well known, sensors like the oxygen sensor 81, although they are very useful in providing an indication of mixture strength for feedback control, are basically on/off devices. FIG. 4 shows the sensor output curve and how the sensor output varies significantly in a very small range relative to the actual change in air/fuel ratio. Therefore, it is desirable to operate on the control line indicated in this figure in the range a–b/a'b' so as to provide the control.

The system as thus far described provides the basic components by which the fuel/air ratio of the engine can be controlled by a feedback control system in order to provide the desired fuel economy and exhaust emission control. This basic system will provide very good control but is limited primarily to situations wherein the engine running characteristics are maintained substantially constant. That is, the feedback control system per se is not necessarily adapted to provide good control under a variety of transient or other conditions, as will be described. In accordance with certain features of the invention, these particular running conditions are accommodated.

The first of these conditions has to do with the provision of good feedback control when there is a transient condition which can effect the responsiveness of the engine. For example, such things as scavenging efficiency can provide a significant effect on the feedback control. For example and as has been noted, it is important that the charge which is delivered to the sensor engine represent actual engine conditions. However, as has also been noted, factors such as scavenging efficiency can effective the output signal.

Figure 5:
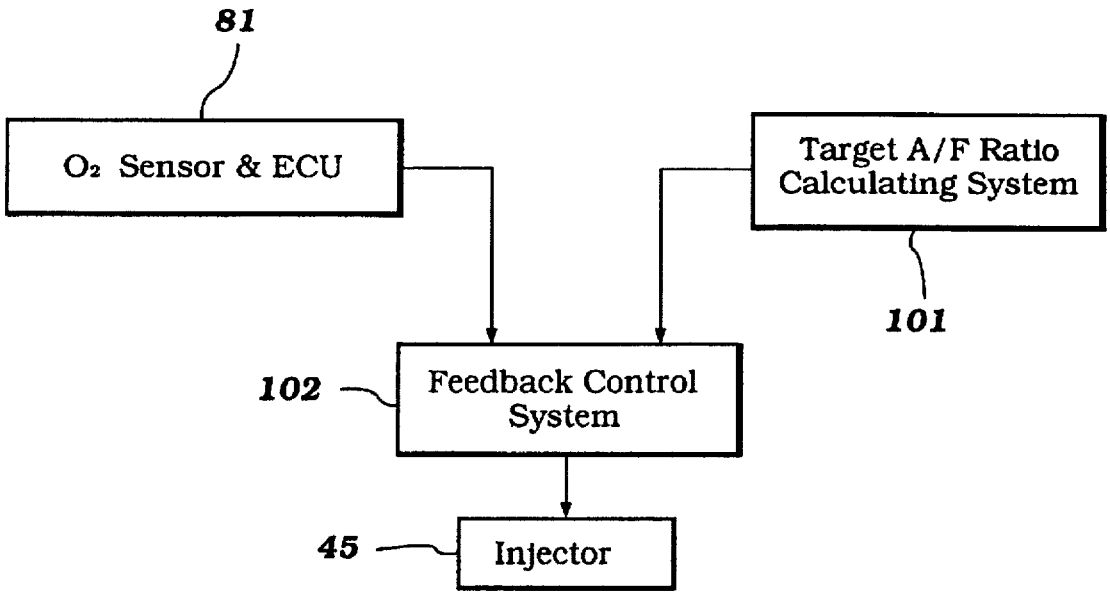
FIG. 5 is a block diagram showing the interrelationship of the sensor, the target air/fuel ratio calculating system, the feedback control system and the actual fuel injection control.

For example, if the scavenging efficiency is low, it may be necessary to provide a richer mixture in order to achieve the actual desired indicated fuel/air ratio and combustion characteristics than when the scavenging efficiency is high. Therefore, and as shown in FIG. 5, the system is provided with an additional calculating system in the ECU 66 which is indicated by the control block 101 and which comprises a target air/fuel ratio calculating system. This system receives certain outputs, as will be described, which are coupled with the outputs from the sensor 81 and the ECU to the feedback control system, indicated schematically at the box 102 in this figure. This then calculates an actual signal to be sent to the fuel injectors 45 so as to provide the desired fuel/air ratio.

Figure 6:
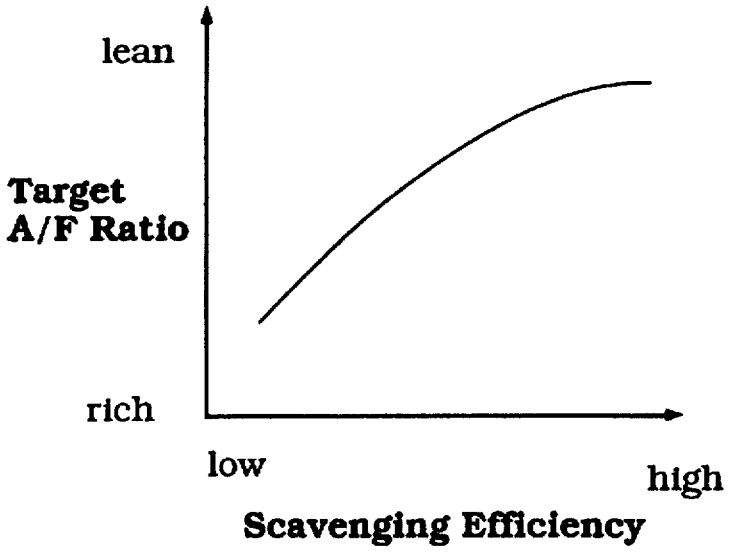
FIG. 6 is a graphical view showing how the target air/fuel ratio varies with scavenge efficiency.

FIG. 6 is a graphical view showing how the target air/fuel ratio should be varied responsive to scavenging efficiency. When the scavenging efficiency is low, then the target fuel/air ratio must be set higher than that when the engine is lean. The reason for this is that poor scavenge efficiency will result in an indication of better combustion in the combustion chamber than is actually present. This is because of the retention of a large residual burned gas charge. However, as the scavenging efficiency improves, then the actual charge that is present in the combustion chamber is more indicative of the actual running conditions per cycle and it is possible to provide a leaner mixture and leaner target air/fuel ratio. Hence, the feedback control system 102 operates in response to both the signals of the target air/fuel ratio as derived from FIG. 6 and the actual output from the oxygen sensor to provide the control signal.

Figure 7:
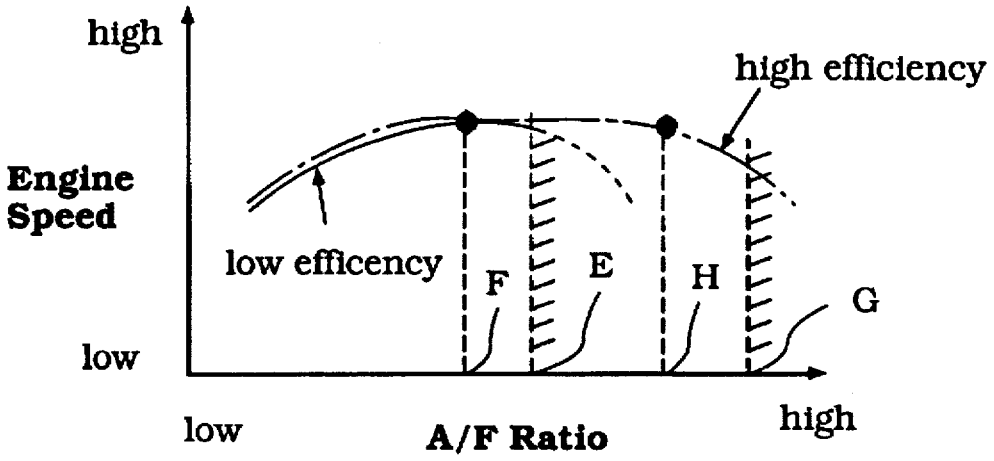
FIG. 7 is a graphical view showing how air/fuel ratio varies with engine speed depending upon scavenging efficiency.

FIG. 7 is a graphical view showing variations in engine speed and desired air/fuel ratio with engines having low scavenge efficiency and high scavenge efficiency with the former curve being shown in solid lines and the latter curve being in dot/dash lines. The lines where the air/fuel ratio if further leaned will result in rough running is indicated by the points E and G on the respective curves. The ideal running is at the points F and H where the efficiency is maintained high and engine running stability is maintained.

Figure 8:
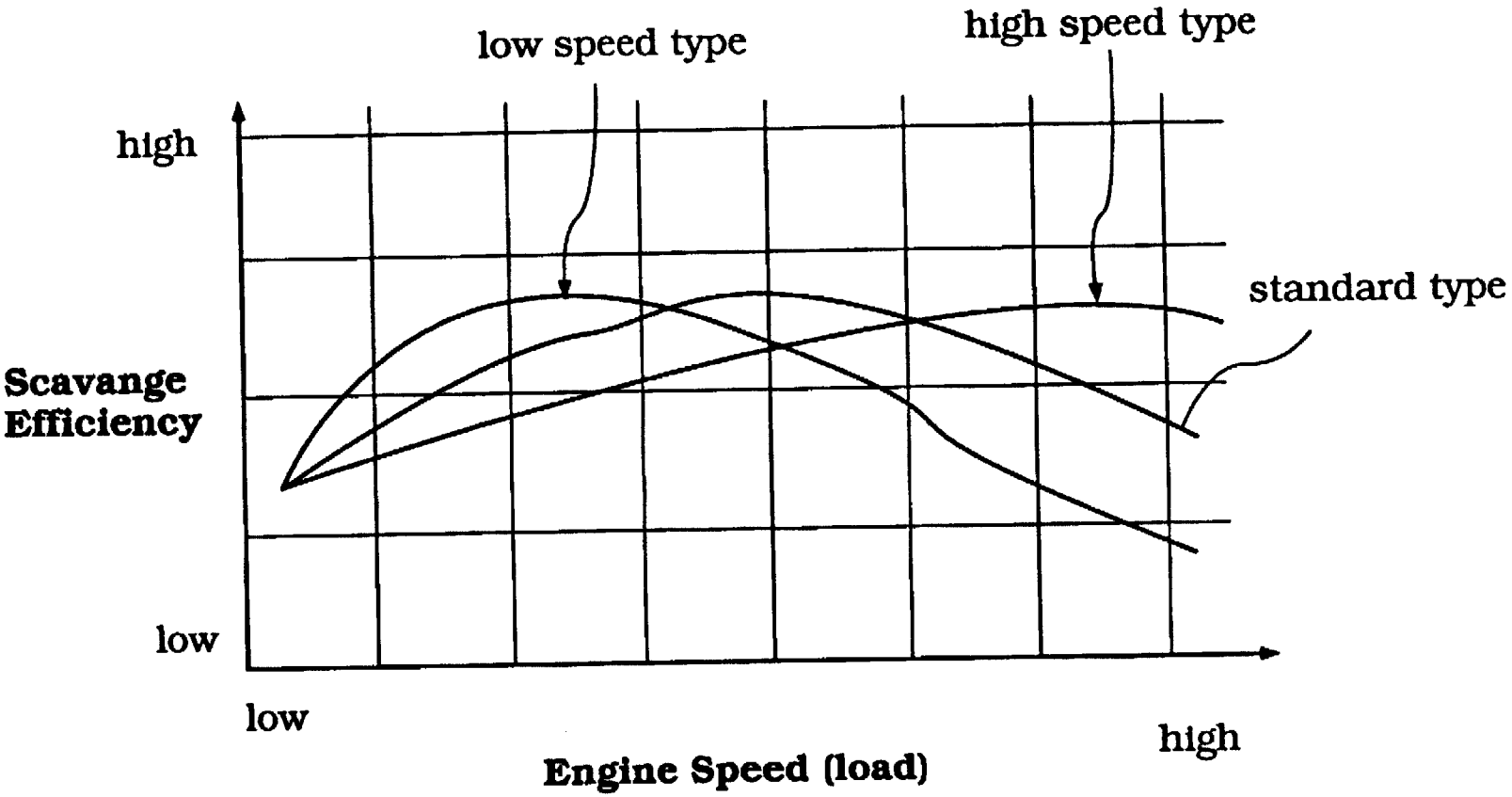
FIG. 8 is a map showing how different engine types can have varying scavenge efficiency related to engine speed or load.
Figure 9:
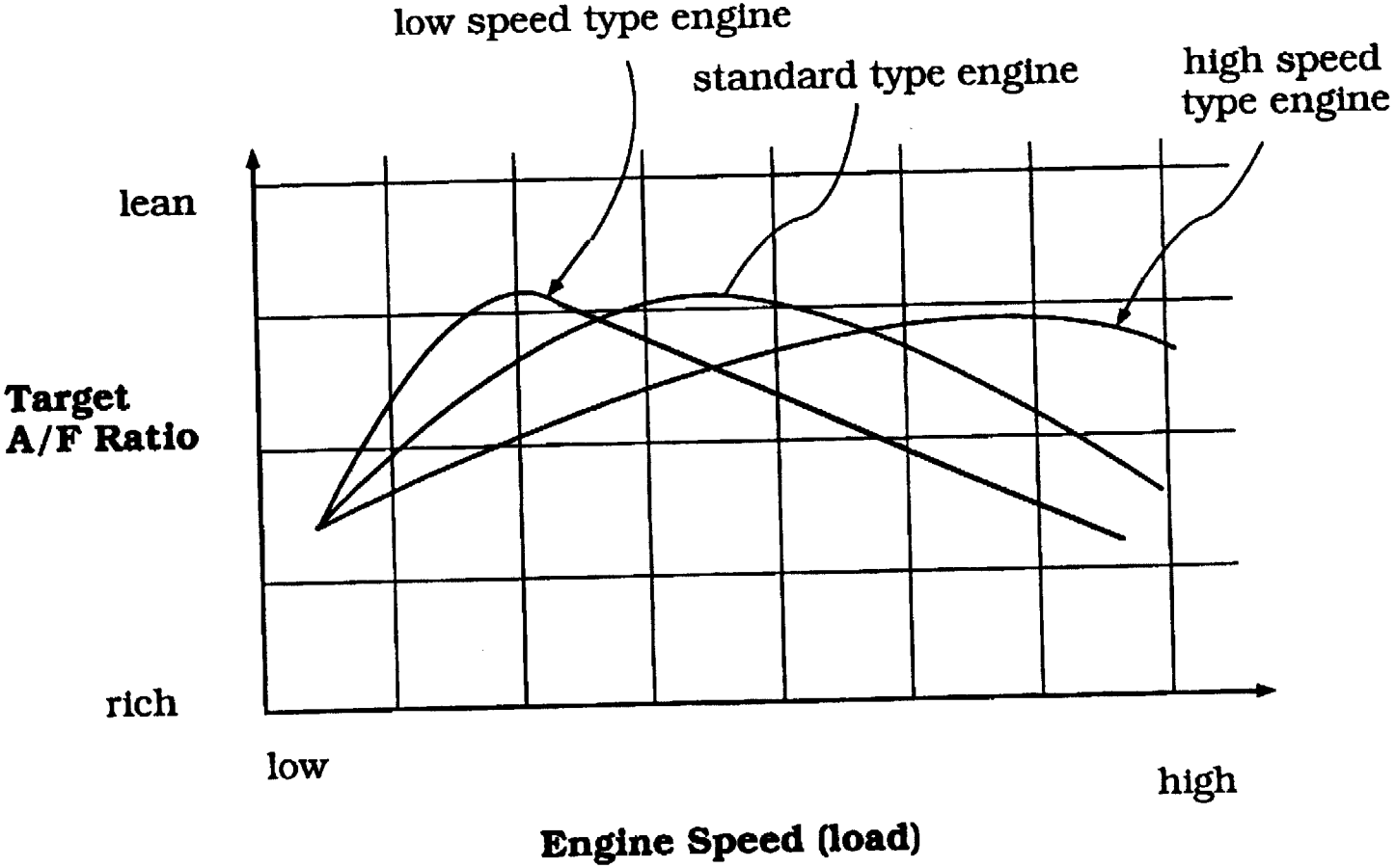
FIG. 9 is a graphical view, related to FIG. 8, and shows how the target air/fuel ratio varies with engine speed or load with the varying type engines.

FIGS. 8 and 9 are graphical views showing how the scavenging efficiency varies with the type of engine and how the target air fuel ratio also varies with respect to engine speed with these different types of engines. Engines that are designed for primarily low speed running have higher scavenging efficiency at low speed with the scavenge efficiency falling off at high speed than high speed engines which have the opposite characteristics. For these reasons, the target air fuel ratio for low speed-type engines should be set higher at low speeds and lower at high speeds. The opposite is true with respect to high speed-type engines for the reasons already noted. The curve for the standard type of engine having acceptable performance throughout the entire speed and load range so as to provide more linear response is also depicted in these figures.

Figure 10:
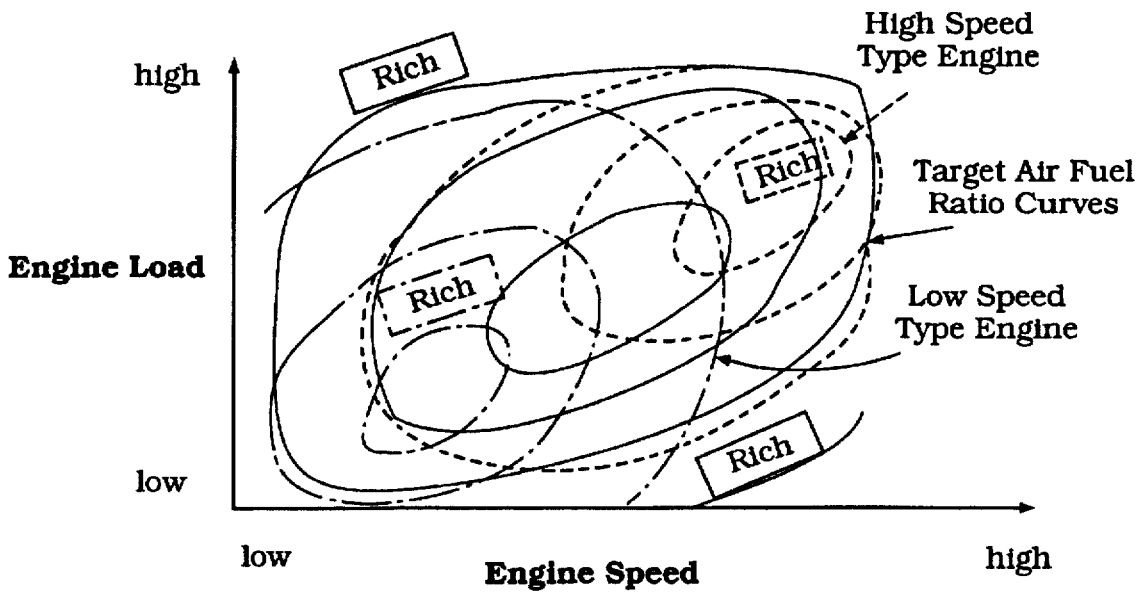
FIG. 10 is a map showing the target air/fuel ratio curves for the various engine types under varying engine speed and load conditions and may represent a control map for the system.

Thus, from each of these curves it is possible to obtain a 3-dimensional map as shown in FIG. 10 wherein the target air fuel ratio can be set in response to sensed engine speed and engine load. This is determined by experimental testing of the engine and is basically programmed into the ECU by way of maps so that the sensed engine speed and load and other sensed factors can be employed so as to select the desired map and target air fuel ratio for the engine type and running conditions.

In addition to the basic engine design, scavenging efficiency is also affected by the back pressure on the exhaust system. In an outboard motor application or in other marine applications, the exhaust gases are, as has been noted, discharge generally through an underwater exhaust gas discharge. This may be conventionally a through-the-hub type exhaust and hence the speed of travel of the watercraft will influence the ability of the engine to discharge exhaust gases and, accordingly, vary the back pressure.

Figure 11:
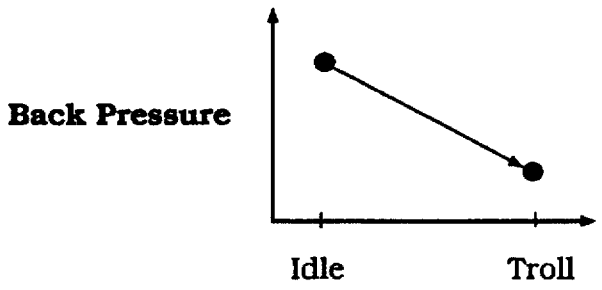
FIG. 11 is a graphical view showing how back pressure varies at low speed depending upon whether an associated watercraft is operating at idle and thus stationary or when trolling.
Figure 12:
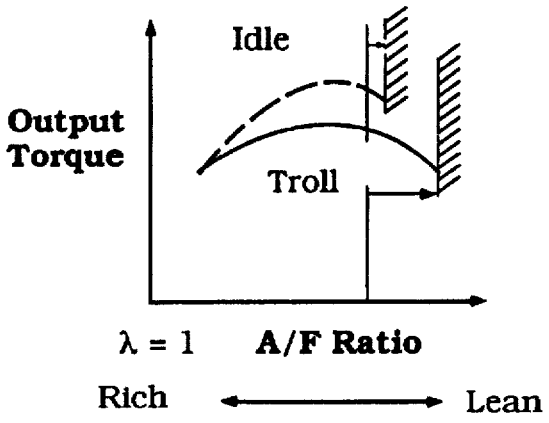
FIG. 12 is a graphical view showing the output torque under varying air/fuel ratios when idle and trolling and showing how the desired mixture condition varies under these running conditions.

For example and has been noted, it may be desirable to provide a transmission condition sensor. The reason for this can be understood by reference to FIGS. 11 and 12 which show respectively back pressure in response to transmission conditions and also output torque in response to air fuel ratio under two transmission conditions. For example, if the engine is idling and the transmission is in neutral, there will be relatively high back pressure in the exhaust system. This is because when the boat or watercraft is not moving, there is static water behind the exhaust gas discharge and back pressure may be high. However, as the transmission is shifted into forward, the watercraft moves forwardly and the pressure behind the propeller will drop and the back pressure will reduce. Thus, the transmission selector may be incorporated so as to provide a variation in the target fuel/air ratio depending upon back pressure as determined by the condition of the transmission sensor.

Figure 13:
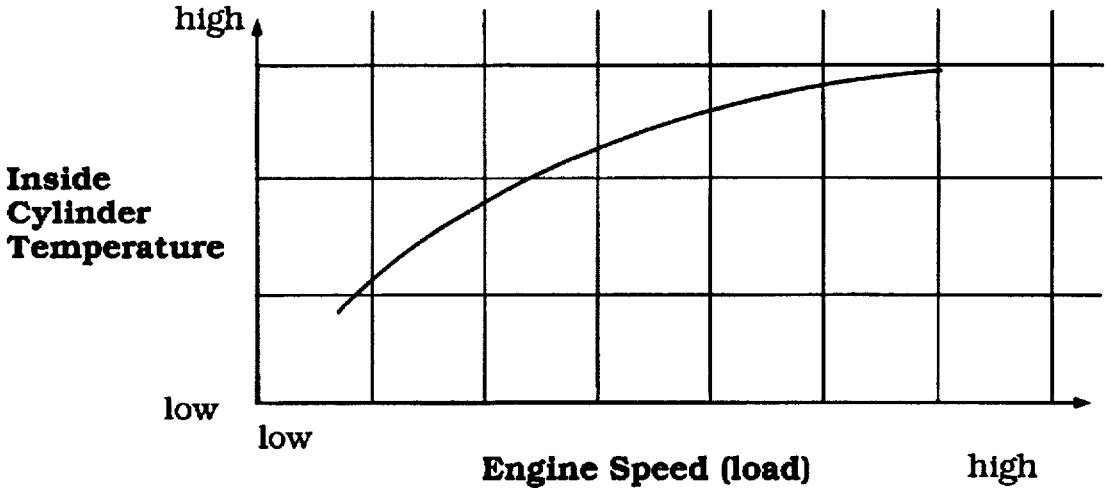
FIG. 13 is a graphical view showing how inside cylinder temperature varies with engine speed and/or load.
Figure 14:
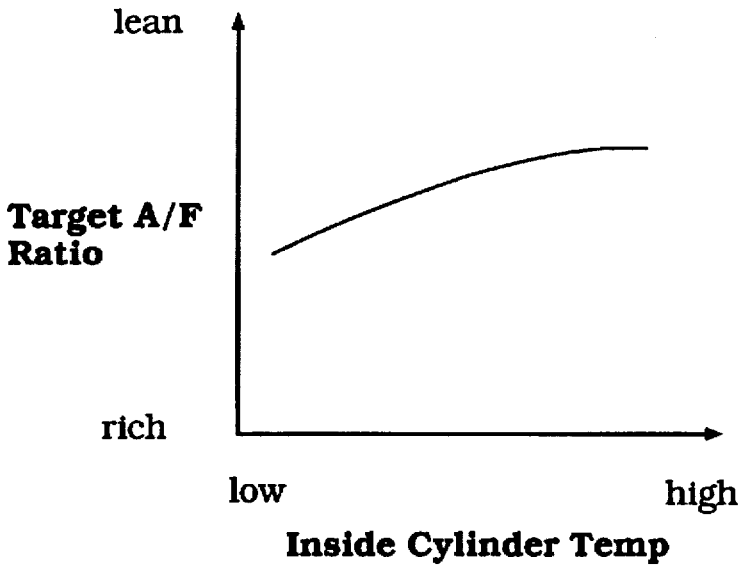
FIG. 14 is a graphical view showing how the target air/fuel ratio varies with inside cylinder temperature.
Figure 15:
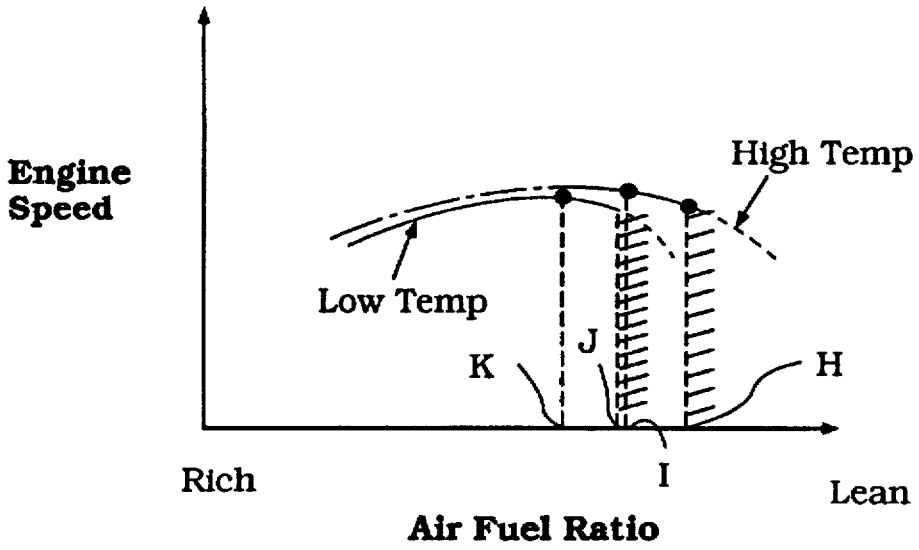
FIG. 15 is a graphical view showing the relationship of engine speed and air/fuel ratio under low temperature and high temperature conditions to show the desired maps in response to these conditions.

Another condition which affects engine operation and desired air fuel ratio is engine temperature. Basically, as the engine speed and load goes up, the in cylinder temperature also raises as shown in FIG. 13. As shown in FIG. 14, as the in engine cylinder temperature goes up it is desired to lean the air fuel ratio. As may be seen in FIG. 15, the engine will begin to run rough at the points I and H depending upon the temperature if the mixture is made too lean. However, the higher the temperature the leaner the mixture can be in order to maintain smooth running without inducing richness. Therefore, the target fuel/air ratio is also set depending upon engine in cylinder temperature which is related to engine load. Hence, either the temperature signal or the engine speed or load signal may be employed so as to vary the target air fuel ratio as set forth by a family of curves as shown in FIG. 15 or a curve as shown in FIG. 14.

The system is designed so as to sense engine conditions and to provide a target signal that is indicative of the actual engine running condition so as to insure that the desired fuel/air ratio will be obtained. As has also been noted, conventional feedback control systems operate so as to provide a finite adjustment in the air fuel ratio in response to deviations. The conventional systems provide a finite adjustment regardless of the degree of deviation. This is done primarily so as to achieve a compromise between a quick speed of response and also to reduce hunting. The larger the adjustment, the more likelihood is that there will be hunting. The smaller the adjustment, the poorer the response time, but the less like likelihood of hunting.

In accordance with another feature of the invention, the feedback control system is modulated so as to provide a control coefficient that will vary the amount of adjustment that is made depending upon the conditions. Therefore, when there is a large deviation between the signal, the coefficient may be set so as to achieve a faster response time. However, on small variations the coefficient is set lower so that the adjustments will be smaller and the likelihood of hunting can be reduced.

This is particularly significant when operating in the start-up mode and when feedback control is originally initiated. When this happens, there is normally a large deviation between the output of the oxygen sensor 81 and the desired target fuel/air ratio as may be seen in the top curve of FIG. 16. This condition occurs before the target fuel/air ratio has been initially sensed by the sensor 81.

Figure 18:
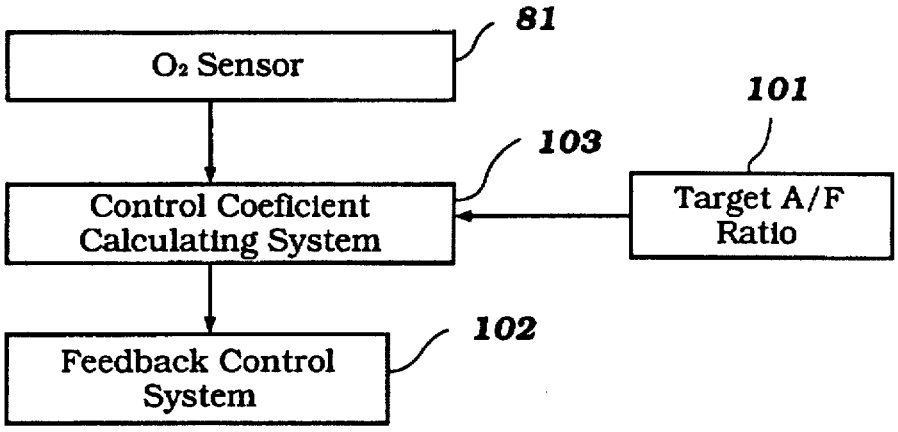
FIG. 18 is a block diagram showing the interrelationship of the components for the feedback control coefficient adjustment.

As shown in this curve, the engine is set to run with a relatively rich mixture on initial starting wherein there is a large fuel injection amount. However, when the feedback control system begins at the starting point indicated on FIG. 16, the system operates so as to provide a feedback control coefficient indicated at the box 103 in the block diagram of FIG. 18 which is determined from a condition wherein there are feedback control coefficients that are determined during the initial start-up operation, indicated at $I_A$ and which vary downwardly as the engine speed is increased or a smaller feedback coefficient $I_B$, which is smaller and still decreases with engine speed.

Figure 16:
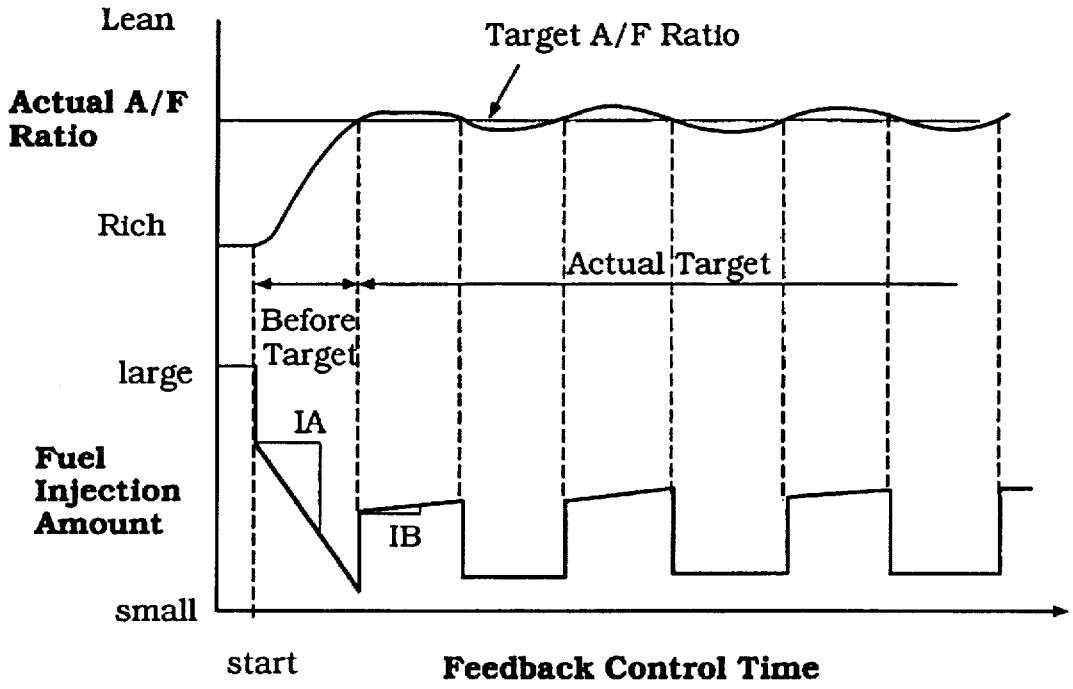
FIG. 16 is a graphical view showing how the air/fuel ratio and fuel injection amounts vary during a control routine in accordance with another phase of the invention so as to provide more rapid response under some conditions.

Hence, before the target reading has first been received, the control coefficient calculating system 103 selects the larger feedback coefficient $I_A$ and the adjustment in fuel injection amount is decreased in a large scope along the line shown in the lower curve of FIG. 16. This condition is maintained until the target fuel/air ratio, which may be set in the manner previously described, is first met as sensed by the oxygen sensor 81. Thereafter, the smaller feedback control coefficient of the curve $I_B$ is chosen. Thus, it will be seen that quick adjustment and quick return to the desired air fuel ratio is possible on start-up, but after the target fuel/air ratio has been first met, then the system operates at a slower coefficient and rate of adjustment so as to maintain stability and reduce the likelihood of hunting.

Figure 17:
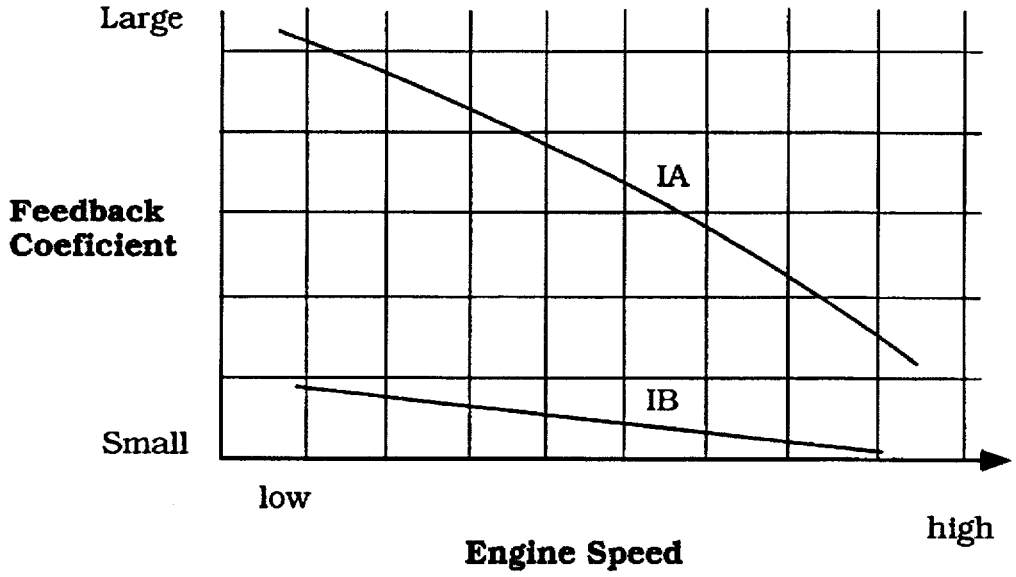
FIG. 17 is a graphical view showing the feedback coefficients and how they vary in response to engine speed and engine load and under the varying feedback control conditions.
Figure 19:
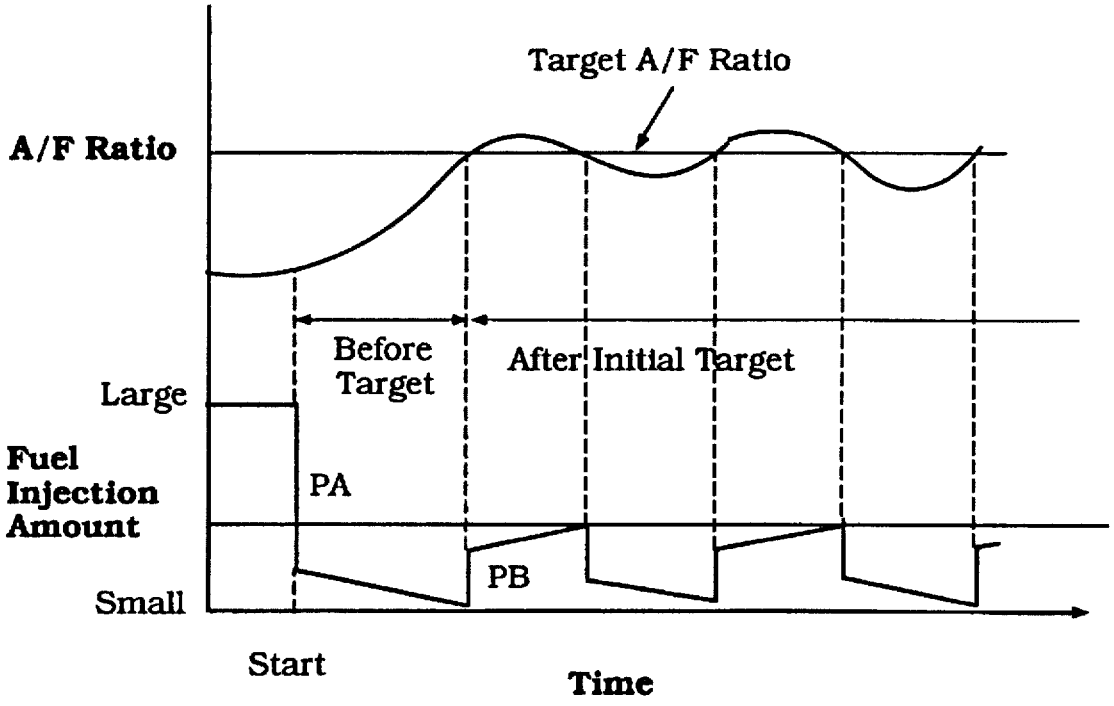
FIG. 19 is a graphical view, in part similar to FIG. 16 and shows how the feedback control system can operate to provide better control in accordance with the invention.
Figure 20:
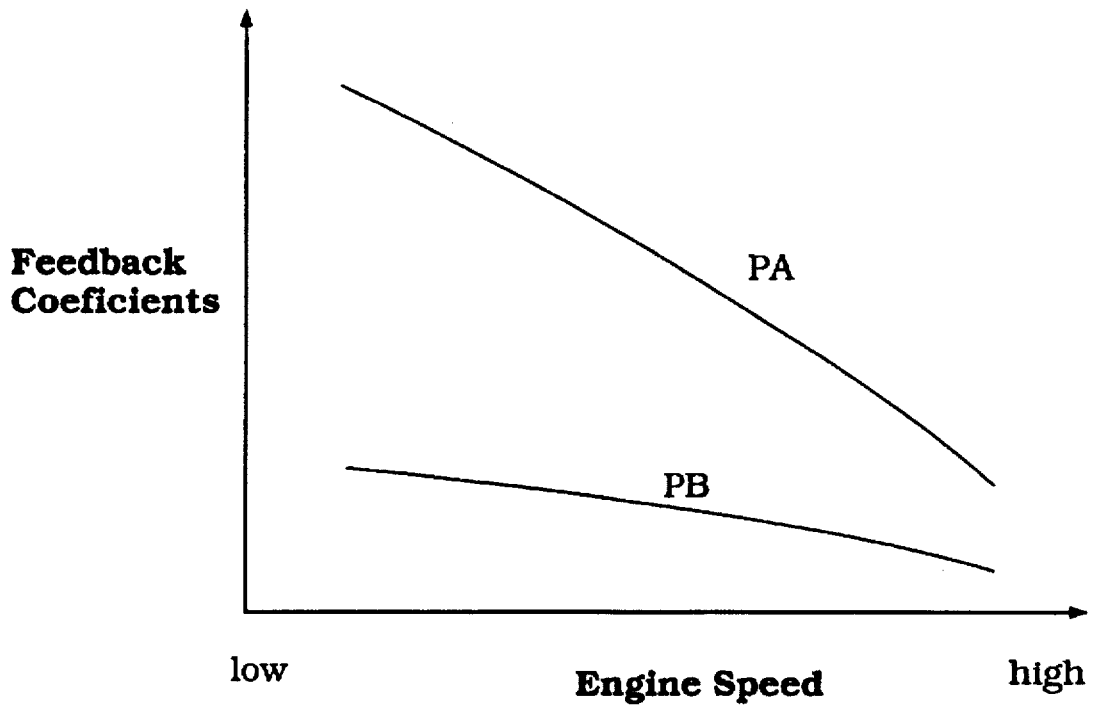
FIG. 20 is a graphical view showing how the feedback control coefficients may be varied with engine speed in conjunction with the diagram shown in FIG. 19.

The embodiment of FIGS. 16 and 17 provides a fixed, initial adjustment for the fuel/air ratio and then a continuing variation along a curve, the slope of which is varied by the feedback coefficient of FIG. 17. FIGS. 19 and 20 show another way in which this can be done. In this embodiment, the amount of initial adjustment is varied and the scope of continuing adjustment is then maintained constant. The amounts $P_A$ and $P_B$ show the feedback coefficients which are determined in response to engine speed from the curve of FIG. 20. Under initial start-up, the amount of initial adjustment P is made large in accordance with the curved $P_A$ before the target has been met and subsequent adjustments are made along a constant slope. However, once the target ratio has been met, then the initial adjustment is made smaller and again succeeding adjustments are made along the same slope. Which of the methods of FIGS. 16 and 17 or 19 and 20 are employed will depend on particular engine parameters.

In addition to the factors which have been described and as should be readily apparent, particularly from the discussion of the characteristics shown in FIGS. 16 and 19, the actual mechanical and electrical components of the system also affect its responsiveness. That is, there are delays in the system reaction which consist of the actual time delays before corrective action is initiated and then further time delays required for the completion of the actual adjustment and the time required for the system to reach a stable operation, assuming all other factors are held constant.

Figure 21:
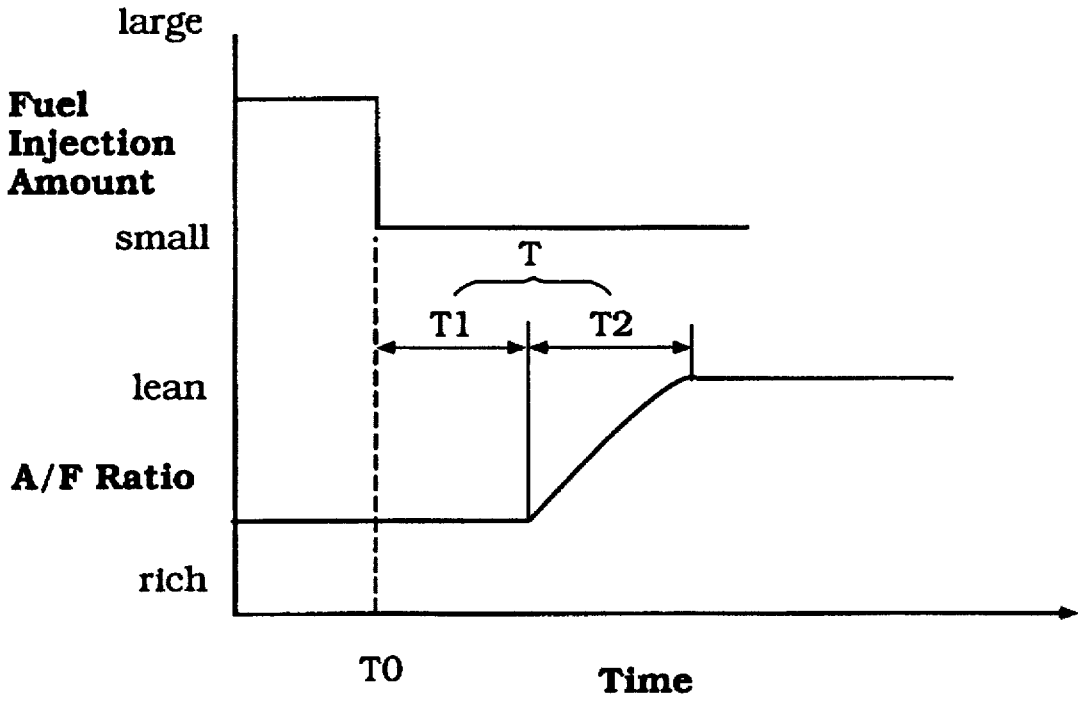
FIG. 21 is a graphical view showing how the inherent system delays can effect the change in air/fuel ratio under transient conditions.
Figure 22:
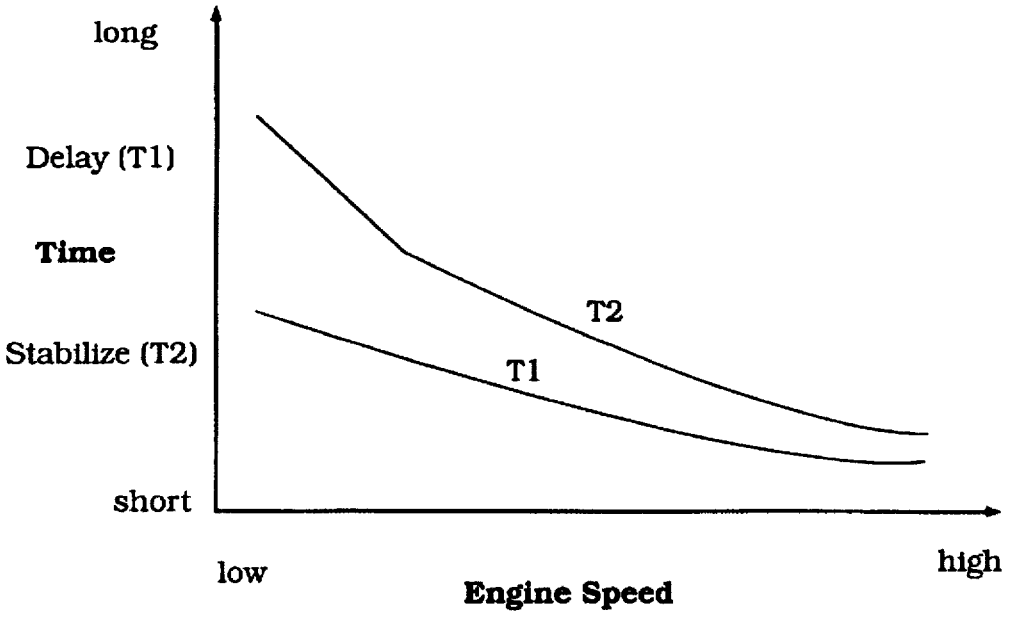
FIG. 22 is a graphical view showing how delay time and stabilizing time vary with engine speed.
Figure 23:
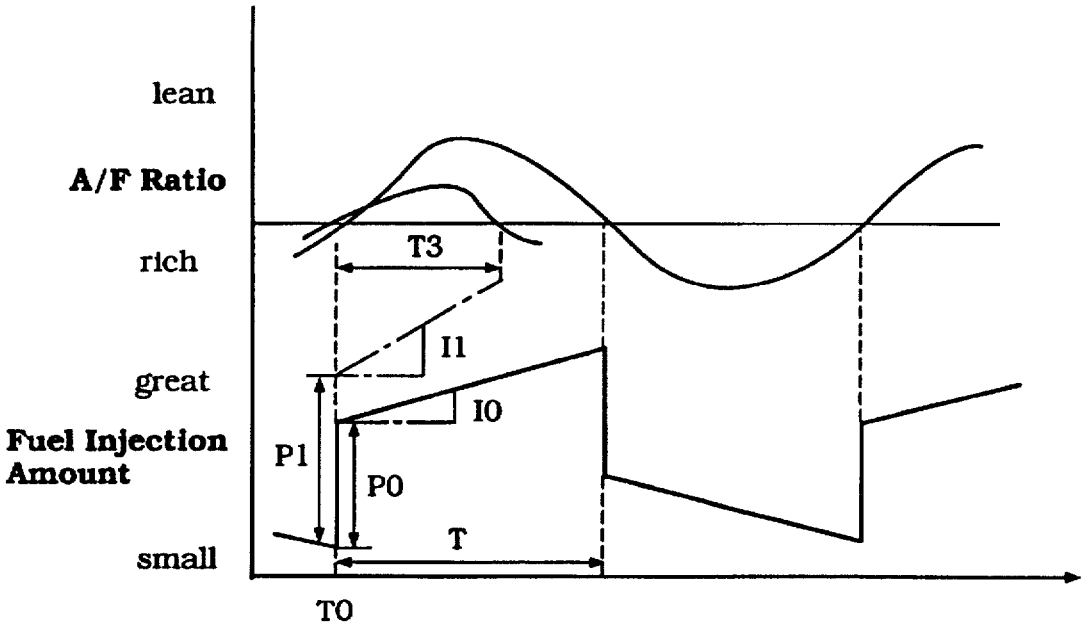
FIG. 23 is a graphical view showing how the system can be operated to be more responsive under transient conditions.

FIG. 21 illustrates this situation in that it shows the actual air fuel ratio which may deviate from the desired ratio and be too rich in accordance with there being too much fuel injection amount. At the time $T_0$, it is determined that the air fuel ratio is too rich and the mixture should be leaned. At this time, there is a time period T1 before the fuel injection amount, which is changed, actually begins to be effected at the fuel injector itself. After this, there is a still further time delay $T_2$ before the fuel/air ratio stabilizes at its new value. Hence, the delay and stabilizing times $T_1$ and $T_2$ will effect the performance.

Figure 24:
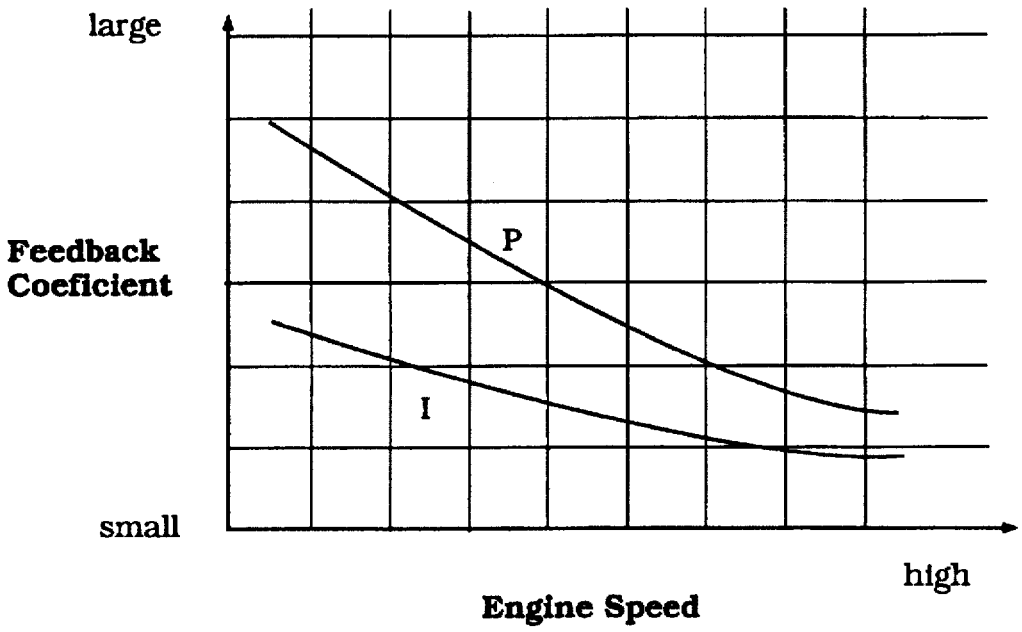
FIG. 24 is a graphical view showing the feedback control coefficients vary with this portion of the engine to improve response time.
Figure 25:
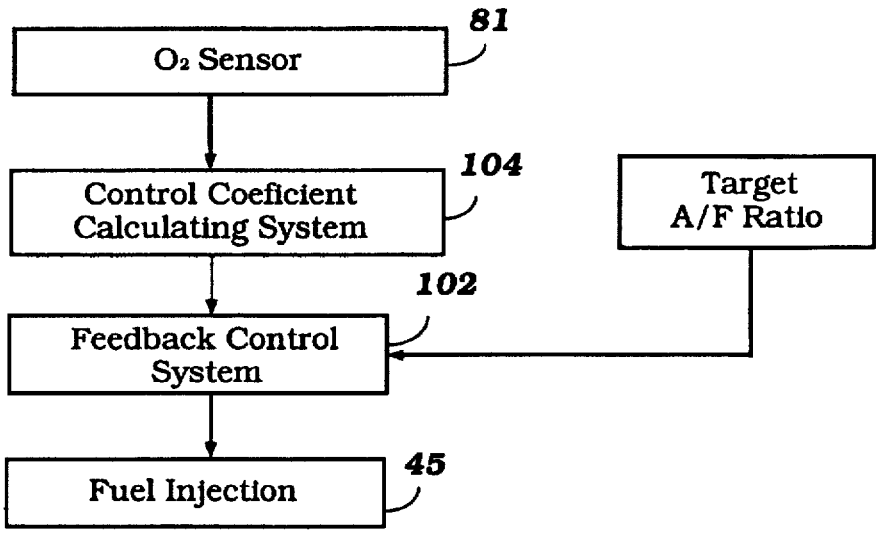
FIG. 25 is a block diagram showing the interrelationship of the components employed to vary the feedback coefficient and the improved responsiveness.

These times are substantially the same regardless of engine speed and hence will be more pronounced on the actual engine performance at low engine speeds than high engine speeds. Therefore, in accordance with a still further embodiment of the invention, the system is provided with the control coefficient calculating system, indicated by the block 104 in FIG. 25, which sets both a value for the initial fuel injection amount variation P as well as the slope curve I for the continuing injection amount so as to maintain the desired ratio. As may be seen, the value P of the initial injection amount is made larger in the feedback coefficient as the engine speed is low, and the slope of the curve I is also varied in this same amount. However, these variations are not parallel curves as may be seen in FIG. 24. By controlling in this manner it is possible to more closely match the actual engine performance with the mechanical components of the system and thus achieve more rapid stabilization of running.

Thus, it should be apparent that the described system provides a number of additional control factors indicative of engine conditions which can be utilized to adjust the target fuel/air ratio and the various feedback coefficients, as noted, so as to maintain optimum performance and obtain quick response without inducing hunting.

Thus, it should be readily apparent from the foregoing description that the described embodiments of the invention are very effective in providing good exhaust emission control and fuel economy for an engine. Although the invention has been described in conjunction with two-cycle engines where it has particular utility, the invention may also be employed in conjunction with four-cycle engines under some circumstances. Various other changes and modifications may be made without departing from the spirit and scope of the invention, as defined by the appended claims.

We claim:

1. A feedback control system for an internal combustion engine having a combustion chamber, a charge forming and induction system for supplying a fuel/air charge to said combustion chamber, an exhaust system for discharging exhaust gases from said combustion chamber, combustion condition sensor means for sensing the condition of the combustion products within said combustion chamber, feedback control means for controlling the charge forming system for varying the fuel/air ratio in response to the output of said combustion condition sensor, means for sensing a condition other than fuel/air ratio, and means for varying one of the manner of making the feedback control or target fuel/air ratio in response to the other sensed condition.

2. A feedback control system as set forth in claim 1, wherein the other sensed condition is a condition which affects engine exhaust gas back pressure.

3. A feedback control system as set forth in claim 1, wherein the other condition comprises temperature.

4. A feedback control system as set forth in claim 3, wherein the temperature is engine in cylinder temperature.

5. A feedback control system as set forth in claim 1, wherein the variation of the feedback control is the speed of variation.

6. A feedback control system as set forth in claim 5, wherein the speed of variation is varied in response to the engine speed, this being the other condition sensed.

7. A feedback control system as set forth in claim 1, wherein the other condition is load on the engine.

8. A feedback control system for an internal combustion engine as set forth in claim 1, wherein the combustion condition sensor senses the combustion products directly from the combustion chamber.

9. A feedback control system for an internal combustion engine as set forth in claim 8, wherein the engine operates on a two-stroke crankcase compression principle and the combustion products are sensed by communicating the combustion condition sensor with the combustion chamber through a port juxtaposed to open at approximately the same time as the engine exhaust port opens.

10. A feedback control system for an internal combustion engine as set forth in claim 9, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

11. A feedback control system as set forth in claim 1, wherein the variation of the feedback control is the rate of feedback control.

12. A feedback control system as set forth in claim 11, wherein the rate of feedback control is high upon initial sensing of the condition.

13. A feedback control system as set forth in claim 11, wherein the rate of feedback control is reduced when the variations from the desired fuel/air ratio are relatively small.

14. A feedback control system as set forth in claim 13, wherein the rate of feedback control is high upon initial sensing of the condition.

15. A feedback control system as set forth in claim 11, wherein the rate of control is varied in response to the initiation of feedback control.

16. A feedback control system as set forth in claim 15, wherein the rate of feedback control is high upon initial sensing of the condition.

17. A feedback control system as set forth in claim 16, wherein the rate of feedback control is reduced when the variations from the desired fuel/air ratio are relatively small.

18. A feedback control system as set forth in claim 16, wherein the initial operation is determined by a large variation from the desired value.

19. A feedback control system as set forth in claim 1, wherein the engine powers a vehicle and the other condition is a vehicle condition.

20. A feedback control system as set forth in claim 19, wherein the other vehicle condition is vehicle speed.

21. A feedback control system as set forth in claim 19, wherein the vehicle comprises a watercraft and the exhaust system discharges the exhaust gases below the level of water in which the watercraft is operating.

22. A feedback control system as set forth in claim 21, wherein the vehicle condition is the transmission condition for the watercraft.

23. A feedback control method for an internal combustion engine having a combustion chamber, a charge forming and induction system for supplying a fuel/air charge to said combustion chamber, an exhaust system for discharging exhaust gases from said combustion chamber, said method comprising the steps of sensing the condition of the combustion products within said combustion chamber, controlling the charge forming system for varying the fuel/air ratio in response to sensed combustion condition, sensing a condition other than fuel/air ratio, and varying one of the manner of making the feedback control or a target fuel/air ratio in response to the other sensed condition.

24. A feedback control method as set forth in claim 23, wherein the other sensed condition is a condition which affects engine exhaust gas back pressure.

25. A feedback control method as set forth in claim 23, wherein the other condition is load on the engine.

26. A feedback control method as set forth in claim 23, wherein the other condition comprises temperature.

27. A feedback control method as set forth in claim 26, wherein the temperature is engine in cylinder temperature.

28. A feedback control method as set forth in claim 23, wherein the variation of the feedback control is the speed of variation.

29. A feedback control method as set forth in claim 28, wherein the speed of variation is varied in response to the engine speed, this being the other condition sensed.

30. A feedback control method for an internal combustion engine as set forth in claim 23, wherein the combustion condition is sensed directly from the combustion chamber.

31. A feedback control method for an internal combustion engine as set forth in claim 30, wherein the engine operates on a two-stroke crankcase compression principle and the combustion products are sensed by communicating a combustion condition sensor with the combustion chamber through a port juxtaposed to open at approximately the same time as the engine exhaust port opens.

32. A feedback control method for an internal combustion engine as set forth in claim 31, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

33. A feedback control method as set forth in claim 23, wherein the engine powers a vehicle and the other condition is a vehicle condition.

34. A feedback control method as set forth in claim 33, wherein the other vehicle condition is vehicle speed.

35. A feedback control method as set forth in claim 33, wherein the vehicle comprises a watercraft and the exhaust system discharges the exhaust gases below the level of water in which the watercraft is operating.

36. A feedback control method as set forth in claim 35, wherein the vehicle condition is the transmission condition for the watercraft.

37. A feedback control method as set forth in claim 23, wherein the variation of the feedback control is the rate of feedback control.

38. A feedback control method as set forth in claim 37, wherein the rate of feedback control is high upon initial sensing of the condition.

39. A feedback control method as set forth in claim 37, wherein the rate of feedback control is reduced when the variations from the desired fuel/air ratio are relatively small.

40. A feedback control method as set forth in claim 39, wherein the rate of feedback control is high upon initial sensing of the condition.

41. A feedback control method as set forth in claim 37, wherein the rate of control is varied in response to the initiation of feedback control.

42. A feedback control method as set forth in claim 41, wherein the rate of feedback control is high upon initial sensing of the condition.

43. A feedback control method as set forth in claim 42, wherein the rate of feedback control is reduced when the variations from the desired fuel/air ratio are relatively small.

44. A feedback control method as set forth in claim 42, wherein the initial operation is determined by a large variation from the desired value.

* * * * *